US006106900A

United States Patent [19]

Innes et al.

[11] Patent Number: 6,106,900

[45] Date of Patent: Aug. 22, 2000

[54] MULTI-LAYER COATING OF ELONGATED STRIP ARTICLES

[75] Inventors: Robert Arthur Innes, Kingston; Neil Louis Brockman, Lansdowne; Melville Douglas Ball, Kingston, all of Canada; Carl Arlen Wollam, Cortland, Ohio

[73] Assignee: Alcan International Limited, Montreal, Canada

[21] Appl. No.: 09/233,524

[22] Filed: Jan. 20, 1999

Related U.S. Application Data

[60] Provisional application No. 60/072,037, Jan. 21, 1998.

[51] Int. Cl.[7] ..... B05D 3/12; B05C 11/04

[52] U.S. Cl. ..... 427/358; 427/356; 118/411; 118/413

[58] Field of Search ..... 427/358, 356; 118/411, 410, 413

[56] References Cited

U.S. PATENT DOCUMENTS

| | | |
|---|---|---|
| 2,761,418 | 9/1956 | Russell . |
| 3,413,143 | 11/1968 | Cameron et al. . |
| 3,496,005 | 2/1970 | Ishiwata et al. . |
| 3,544,669 | 12/1970 | Schock ..... 264/174 |
| 3,573,965 | 4/1971 | Ishiwata et al. . |
| 4,600,550 | 7/1986 | Clören . |
| 4,675,230 | 6/1987 | Innes . |
| 5,030,484 | 7/1991 | Chino et al. . |
| 5,072,688 | 12/1991 | Chino et al. . |
| 5,186,754 | 2/1993 | Umemura et al. . |
| 5,622,562 | 4/1997 | Innes et al. . |

FOREIGN PATENT DOCUMENTS

| | | |
|---|---|---|
| 0392810 | 10/1990 | European Pat. Off. . |
| 1548788 | 10/1968 | France . |
| 2741285 | 5/1997 | France . |
| 1546968 | 12/1970 | Germany . |
| 4101621 | 7/1991 | Germany . |
| 4142576A1 | 6/1993 | Germany . |
| 4328766 | 5/1994 | Germany . |
| 837095 | 6/1960 | United Kingdom . |
| 1208809 | 9/1963 | United Kingdom . |
| 1562601 | 3/1980 | United Kingdom . |
| WO 94/03890 | 2/1994 | WIPO . |
| WO9529766 | 11/1995 | WIPO . |

OTHER PUBLICATIONS

Advertisement—"*EDI Multi–Manifold Coextrusion Dies*" 1992 Extrusion Dies, Inc. Printed in USA (no month date).

*Primary Examiner*—Katherine A. Bareford
*Attorney, Agent, or Firm*—Cooper & Dunham LLP

[57] ABSTRACT

A method of applying a multi-layer coating to a surface of an elongated strip article (10) of variable thickness or surface height. The method involves applying at least two layers (12*a,* 12*b*,) of different coating materials in the form of solidifiable fluids directly onto the surface (10*a,* 47, 48) of the elongated metal strip article and reducing the layers to a desired thickness by causing the applied coating materials to encounter at least one coating surface (27) that is movable substantially perpendicularly relative to the strip article and is urged towards the strip article in opposition to hydrodynamic force generated by the coating materials on the at least one coating surface. Differences of thickness or surface height of the strip article are therefore accommodated unduly varying the coating thickness. In the method, one layer (12*b*) is coated on top of another (12*a*) in such a way that an outer coating layer is applied on an immediately underlying layer before the immediately underlying layer solidifies. The invention also relates to apparatus for carrying out the method.

22 Claims, 4 Drawing Sheets

MULTI-LAYER COATING OF ELONGATED STRIP ARTICLES

CROSS-REFERENCE TO RELATED APPLICATION

This application claims the priority right of U.S. provisional patent application Ser. No. 60/072,037, filed Jan. 21, 1998 by applicants herein.

BACKGROUND OF THE INVENTION

This invention relates to the formation of multi-layer coatings on elongated strip articles. More particularly, the invention relates to the formation of coatings having two or more layers of coating materials on the surfaces of elongated strip articles, e.g. aluminum sheet material.

There are many reasons why it is desirable to coat elongated strip articles, e.g. aluminum sheet, with layers of coating materials. For example, such coatings can provide the underlying strip material with protection against attack by harmful chemicals, the atmosphere or pollution, etc. Moreover, in the food industry, it may be desirable to protect packaged articles (e.g. foodstuffs) from attack by or contamination with components of the material forming the elongated strip articles used for packaging.

While single coating layers may be used for these purposes, multiple coating layers of different materials are frequently advantageous. For example, it may be advantageous to provide an inner layer that has good adhesion to the underlying surface and an outer layer having good lubricity for forming operations, or other desirable characteristics, such as peelability, product release characteristics, etc.

While coating materials used for this purpose are often solids dissolved or suspended in volatile solvents or aqueous media (e.g. conventional paints), in some cases it is more desirable to use molten polymers that are coated directly onto substrate surfaces and allowed to cool and harden, or to use liquid polymers that are subsequently cured by heat or radiation. The use of undissolved polymers has the advantage that atmospheric pollution by solvent vapors can be avoided.

Methods of and apparatus for applying multi-layer coatings of materials onto suitable elongated substrates are already known, as briefly described below.

U.S. Pat. No. 2,761,418, which issued on Sep. 4, 1956 to T. A. Russell, discloses a multiple coating apparatus intended primarily for producing photographic film. The apparatus uses a coating head capable of simultaneously applying two layers to a surface of a moving web of material.

U.S. Pat. No. 3,413,143, which issued on Nov. 26, 1968 to E. Cameron et al., discloses a method of and an apparatus for applying a liquid to a moving web, again primarily intended for coating photographic materials. The apparatus employed a coating head capable of simultaneously applying multiple coatings of different materials.

U.S. Pat. No. 3,573,965, which issued on Apr. 6, 1971 to Mamoru Ishiwata et al., discloses an improved so-called multiple doctor coating method. This involves the use of a coating head having multiple liquid chambers and coating slots leading from the liquid chambers to the coating face. The parts of the coating face between the slots form doctor edges which control the flow of the coating materials onto the moving substrate surface.

U.S. Pat. No. 5,072,688, which issued on Dec. 17, 1991 to Chino et al., describes a process and apparatus for producing multi-layer coatings useful for magnetic recording media. The coatings are produced by an extrusion-type coating head in which different coating solutions are pumped into different pockets formed in the head and are passed through narrow slits meeting at a coating slot formed at the ends of the slits.

U.S. Pat. No. 5,186,754, which issued on Feb. 16, 1993 to Umemura et al., discloses an extruder for coating magnetic layers onto a tape. The coating is produced by a coating head provided with two liquid reservoirs, each having an outlet channel. The channels merge before reaching the coating surface of the coating head to form a single coating slot.

International (PCT) patent publication WO 94/03890 published on Feb. 17, 1994 in the name of BASF Magnetics GmbH discloses a coating arrangement for magnetizable coatings having a coating head provided with a particular geometry and utilizing a magnet to ensure a stabilized coating.

While these known arrangements are capable of producing multi-layer coatings on substrates, they are mostly intended for use with very thin flexible substrates of uniform thickness, such as the backing material ribbon used for magnetic tapes or photographic films. All of the known arrangements employ coating heads held in a fixed position relative to a path normally followed by the substrate to be coated. However, such arrangements are not well suited to the application of thin coatings to metal strip articles, such as aluminum sheet, because they cannot easily adjust to the variations in thickness and surface height characteristic of moving strip articles of this kind. Therefore, they cannot easily be employed for the type of multi-layer coating contemplated above since coating layers having unacceptable variations in thickness are thereby produced and, in some cases, the fixed coating head may contact the surface to be coated, resulting in damage.

There is therefore a need for an improved coating method and apparatus for forming multi-layer coatings on elongated strip articles of the type mentioned above.

BRIEF SUMMARY OF THE INVENTION

An object of the invention is to provide a method and apparatus for forming multi-layer coatings on elongated strip articles likely to be of somewhat variable thickness or to have surface irregularities, e.g. metal strip articles.

Another object of the invention is to provide a method and apparatus for forming multi-layer coatings of polymeric material on elongated strip articles, particularly metal sheets.

According to one aspect of the invention, there is provided a method of applying a multi-layer coating to a surface of an elongated strip article of variable thickness or surface height, comprising applying at least two layers of different coating materials in the form of solidifiable fluids onto said surface of said elongated strip article, and reducing said layers to a desired thickness by causing said applied coating materials to encounter at least one coating surface that is movable substantially perpendicularly relative to said strip article and is urged towards said strip article in opposition to hydrodynamic force generated by said coating materials on said at least one coating surface, thereby accommodating variations in thickness of said strip article or differences of surface height without unduly varying said coating thickness, said layers being applied one on top of another such that an outer layer is applied on top of an immediately underlying layer before said immediately underlying layer has solidified.

To prevent damage to the newly formed multi-layer coating, or to the coating apparatus, it may be desirable to fully solidify the coating on the strip article by drying or cooling or hardening (whichever is appropriate) before it is contacted by guidance devices (e.g. rollers or deflection surfaces) for controlling the path of the strip article on the downstream side of the coating point. This may be done, for example, by causing the coated strip article to pass through a drying oven or over a cooled surface (e.g. a polished, water-cooled quench roll). Such a device may be provided close to the coating head(s) on the downstream side.

It will, of course, be apparent that the multi-layer coating may be applied to a strip article having any orientation, i.e. the strip may be traveling horizontally or vertically, or at any desired angle to the horizontal when the coating is applied.

The invention may be used to form very thin multi-layer coatings, e.g. those having thicknesses of less than about 10 microns, although thicker films, e.g. those of 20 microns or more in thickness, may also be produced.

The coatings may be applied to metal strip articles of any desired thickness and metal composition, most preferably aluminum or aluminum alloys. Even when quite thin, such articles are different from polymer films and similar thin flexible substrates used for photographic film, magnetic tape and the like, in that surface irregularities and thickness variations of metal strip articles are not smoothed out to any significant extent by the type of forces applied during surface coating. The method of the invention is therefore required to accommodate such irregularities. Moreover, metal strip articles, particularly those made of aluminum and aluminum alloys, are also often provided with a "conversion coating" before the application of the coatings of solidifiable fluid of the present invention. This involves treating the surface with chromate-based or non-chromate-based (e.g. zirconia-based) chemicals to prevent corrosion under, and to promote adhesion to, a conventional paint layer. Such chemical pre-treatment is compatible with the coating method of the present invention.

The term "solidifiable fluid" is intended to mean any fluid coating material that solidifies by normal cooling or drying after a period of time under the conditions in which the method is operated, e.g. a molten thermoplastic or a solid dissolved in a volatile solvent or water, or that is solidified upon further treatment, such as curing by heat or irradiation.

The solidifiable fluids used in the present invention are thus usually molten or liquid polymer coatings or solvent-based lacquers or paints. The liquid/molten polymers may be either thermoplastic (e.g. polyesters, polyolefins such as polypropylenes, polyethylenes, etc., polycarbonates, and vinyl resins such as PVA and PVC), or thermosetting (e.g. epoxies). The solvent-based coatings may be organic solvent-based coatings or water-based coatings.

In the present invention, when a layer is applied over a layer already formed, the underlying layer is still fluid, although perhaps slightly more viscous than when it was first applied. The time interval between successive coating steps (in practice, normally 5 seconds or less) is short enough for the coatings employed to avoid complete drying or solidification. If desired, the layers may be applied essentially simultaneously, e.g. from the same coating head and even from the same coating slot (as will be apparent from the description below).

If more than two layers are applied successively, it is only necessary that an underlying layer still be fluid when a further layer is applied directly on to it. Thus, a first layer may have become solid when a third layer is applied over a second coating layer, but the second layer should itself still be fluid. In many cases, however, the coating times are such that all of the underlying layers, e.g. first and second layers, are still liquid when a third (often final) layer is applied.

In the case of molten polymers, the temperature of an underlying layer is still above the "melting point" of the polymer when a further layer is applied directly onto it. The molten polymer may cool and increase in viscosity, but will generally not fall below its melting point until it passes through a subsequent quenching operation.

According to another aspect of the invention, there is provided apparatus for applying a multi-layer coating to a surface of an elongated strip article of variable thickness or surface height, comprising: at least one coating head provided with at least one open-sided slot and at least one associated coating surface adjacent to said slot for contacting and metering coating material emerging from said slot; force application device for urging said at least one coating head towards said elongated strip article to counterbalance a hydrodynamic force exerted on said at least one coating surface by coating material contacting said coating surface; drive apparatus for advancing said elongated strip past said at least one coating head; and supply apparatus for supplying at least two solidifiable liquid coating materials to said at least one coating head to be applied to said surface of said strip article in the form of coating layers arranged one on top of another; wherein said at least one coating head is arranged such that, in use, an outer coating layer is applied on top of an immediately underlying coating layer before said immediately underlying layer has solidified.

It should be noted that, when the layers are applied sequentially, the anticipated time interval between the application of the first coating layer and each successive coating layer by this apparatus will depend on the spacing between coating application heads, or between slots in such coating heads, and the speed of advancement of the strip. For the commercial processes anticipated here, this time interval will generally be 5 seconds or less, preferably 1 second or less, and most preferably 0.5 seconds or less. For a high speed line with a compact coating head arrangement, time intervals of less than 0.1 seconds would be possible.

Furthermore, unlike many other multi-layer coating processes, it is not necessary to incorporate any drying, cooling or curing steps between the successive coating applications; in fact, the provision of such steps is to be avoided (i.e. there is an absence or lack of such intervening drying, cooling or curing steps). In the case of solvent-borne coatings used in conventional processes, the solvent content of the coating as applied is typically about 80%. The conventional drying/curing process to remove the solvent involves passing the coating through a long oven (with a typical residence time of more than about 10 seconds at elevated temperature). Such a step is not required in the present invention. Many conventional coating systems used for such things as products involved automotive products involve complicated multi-step procedures to apply primers, intermediate coating layers and top coats with drying and curing steps after each coating step. Consequently, the coating lines are often very long and complicated and require large amounts of energy for the multiple drying and curing operations. This absence of drying or curing steps in the present invention represents a significant advantage in both productivity and energy saving when compared to the conventional application of multi-layer coatings The present invention makes use of the surprising finding that two or more coating layers can be applied while the layers are still wet or fluid without the need for intermediate drying, cooling or curing to avoid unacceptable mixing of the layers. This not only saves time, energy and equipment (capital costs), but has the additional advantage that the bond formed between the respective layers is usually enhanced in strength (compared to the bond achievable by liquid-on-solid coating) because of a small amount of intermingling of the layers that takes place at the interface as the layers solidify.

When the coating materials are molten or liquid polymers, the method of the invention has the advantage that virtually zero emissions of polluting solvents are possible (e.g. the curing of liquid polymers generally generates less than 5% solvent). Moreover, it has been found possible to produce, from molten polymers, multi-layer coatings that are very thin (e.g. 10 $\mu$m or less) at high coating lines speeds (e.g. 200 m/min or greater).

By judicious choice of the coating materials for the multi-layer coatings, unique property combinations can be achieved. For example, a layer which contacts the strip article may be chosen to have good adhesion properties for the substrate. In the case of aluminum sheet or foil as the substrate strip article, a maleic acid modified polyolefin or polyester may he chosen for good bonding characteristics. However, such polymers may not be ideal for outer layers intended to contact food or beverages. A different polymer would be chosen for the outer layer(s), e.g. one having minimal impact on the flavor of the contained foodstuff. In the case of retortable food containers, a polymer coating formulation with good product release characteristics would be advantageous.

Outer polymer layers may be chosen for good formability, good mechanical strength, low cost, etc. Low cost, possibly recycled polymer may then be used as an internal layer to provide the coating with the necessary thickness.

In the case of three-layer coatings, a central "tie layer" may be provided between innermost and outermost layers to provide better adhesion between those layers, for example if the innermost and outermost layers are made of materials having quite different properties and therefore have little tendency to adhere together. The innermost layer may then be selected to provide good adhesion to the strip article, the outermost layer may be selected for good exterior effects and the central layer may be used to bind the two together.

Alternatively, a central layer in a three-layer coating may be used just to increase the thickness of the coating. This layer may be made of the least expensive suitable material (e.g. reground (recycled) polymer or polymers) in order to minimize costs.

In contrast, it it is desired to produce a peelable structure, e.g. a lidding foil (such as a foil lidding for yoghurt or preserves), a combination of layers may be chosen to generate a peelable interface between two of the component layers (i.e. which allows a lid to be peeled easily from a container). This can be done by using materials for successive layers that form only weak bonds, i.e. materials that tend to resist intermingling at the interface. If this is done by using polymers dissolved in organic solvents or water, coating qualities are poor and "pinholes" and the like are often formed. When using molten polymers, however, good coating effects can be achieved even though the resulting bond between the layers is weak.

It will be apparent that the present invention makes possible a wide variety of coating combinations to meet the requirements of different intended uses. In addition to food and beverage packaging, opportunities for such multi-layer coatings also exist, for example, in building products and in automotive sheet applications. In the latter cases, however, the coating thicknesses would typically be thicker than those used for food packaging applications and the like.

The invention also makes possible various decorative effects. Decorative bands may be created by turning off one or more of the coating heads or coating slots (usually leaving at least one operational) at regular intervals during the coating operation. If colored polymers are used (e.g. a strong colour for an outer layer and white or clear for an underlying layer), this may produce a noticeable banding pattern, the bands being oriented transversely to the direction of strip advance. The thickness of the bands will depend on the speed of strip advance and the time during which one or more of the coating materials is turned oft. If coating materials of the same color are used, there may still be a decorative effect caused by the resultant undulating height of the coating along the strip (the strip will be thicker in those regions where all coating layers are present than in those regions where fewer are present).

DETAILED DESCRIPTION OF THE INVENTION

Figure 1:
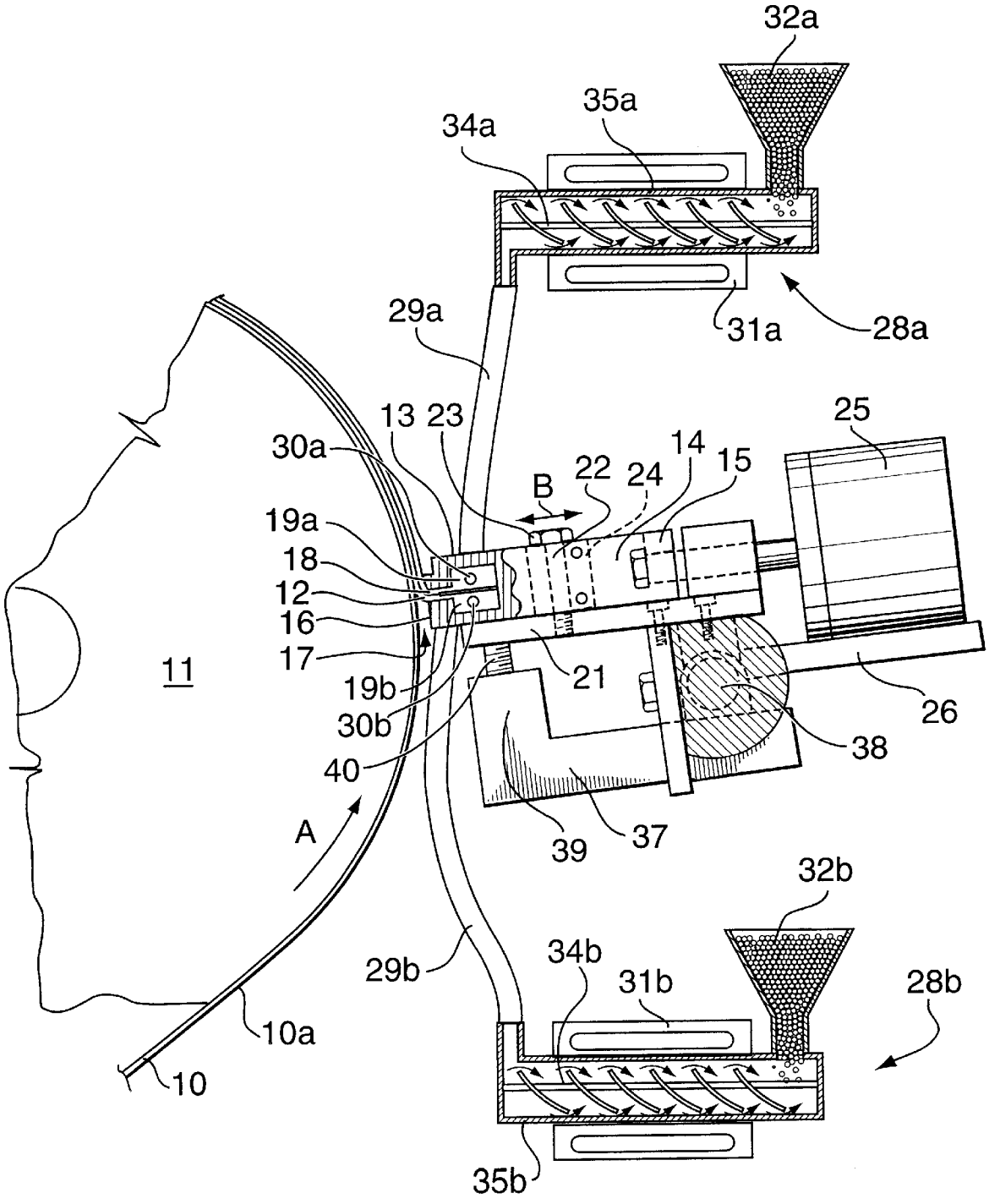
FIG. 1 is a partial side view of one embodiment of an apparatus according to the present invention.

An apparatus for coating elongated strip articles is shown and described in U.S. Pat. No. 4,675,230, which issued on Jun. 23, 1987 to Robert A. Innes and is assigned to the same assignee as the present application (the disclosure of this patent is incorporated herein by reference). The Innes patent discloses the formation of a single-layer coating on an elongated strip article such as a sheet of aluminum or aluminum alloy. The apparatus makes use of a coating head provided with a surface having an open-aided slot, to which the coating material is supplied under pressure, and an angled coating surface or land adjacent to the slot against which the coating material exerts a pressure as it is being applied. A load is continuously exerted on the coating head, urging the coating surface against the applied coating layer so as to maintain a uniform coating gap between the head and the coated strip surface. The head does not contact the strip surface but "floats" on the layer of coating material as it is applied and moves under the load to accommodate differences in the thickness of the strip or the height of the strip surface as coating proceeds.

U.S. Pat. No. 5,622,562 to Innes et al., which issued on Apr. 22, 1997 and is assigned to the same assignee as the present application, describes a similar coating apparatus and method for coating strip articles with molten layers of polymer material. The disclosure of this patent is also incorporated herein by reference.

While apparatus of this kind has proven extremely suitable for producing single-layer coatings of paints or polymers onto strip articles, the apparatus has not been regarded as suitable for producing multiple coating layers. This is because the coating material in the Innes and Innes et al. apparatus experiences extremely high shear rates as it exits the slot in the coater head, and encounters high pressures from the coating surface as the coating head is forced towards the surface of the strip article. The high shear was expected to cause turbulence at the exit of the coating slot, resulting in mixing of liquid layers, and the pressure from the coating head was believed likely to result in a loss of integrity between multiple layers as they were coated. However, the inventors of the present invention have now surprisingly found that this known apparatus may nevertheless be modified to achieve desirable multi-layer coatings.

The present invention makes use of a coating apparatus and method similar to that of Innes or Innes et al., but provides a coating head having a plurality of channels for different coating materials leading to one or more open-sided coating slots in a single coating head, or makes use of numerous separate coating heads to apply the different layers sequentially. Surprisingly, acceptable multi-layer coatings are thereby achieved, even when extremely thin coating layers are applied.

It should be noted that one of the unique features of this process compared to many (if not all) the conventional alternatives, is the shear rate regime in which the coating head operates. The shear rate (SHEAR) is determined from the strip speed (v) and the thickness of the coating (x) (the separation distance between the part of the coating head surface closest to the strip and the strip surface itself) at the point of application according to the equation:

$$SHEAR = \frac{v}{x}$$

For example, for a strip velocity (v) of 200 m/second and a coating thickness (x) of 10 microns, the shear rate SHEAR= $2\times10^7$ per second. Alternatively, for a strip velocity of 100 m/second and a coating thickness of 100 microns, the shear rate SHEAR=$10^6$ per second.

For conventional extrusion coaters (i.e. those not of the Innes or Innes et al. type), the shear rate at the coating point is small and certainly much less than $10^4$ per second. However, in the method described herein, shear rates generally exceed $10^4$ per second, and frequently exceed $10^6$ per second.

Typical commercial line speeds are about 200 m/second or more for the products envisioned for the present invention (e.g. coated can-end stock). Typical coating thicknesses of interest would generally be 10 microns or less but thicker coating for some applications may be appropriate. It is unlikely that any commercial coating operation based on the present invention would involve shear rates of less than $10^4$ per second.

As noted earlier, these very high shear rates are substantially different from those experienced in other known coating equipment. Given these extremely high shear conditions, the ability to maintain two or more distinct layers during coating is surprising.

The high shear environment associated with the coating process of the present invention applies to molten polymers in a different manner than it does to solvent-borne coatings. Under high shear, a polymer melt behaves like a low viscosity solution because of its shear thinning characteristics. Once the polymer is behaving like a low viscosity coating, it benefits from the high shear laminar flow operation in the same way that a solvent-borne coating does. In both cases, the layers more or less maintain their identity and do not completely mix together.

A first preferred embodiment of the invention is described in detail in the following with reference to FIGS. 1 and 2.

FIG. 1 shows that a metal strip article 10 to be coated is continuously advanced in the direction of arrow A (by suitable and e.g. conventional drive apparatus) longitudinally parallel to its long dimension from a coil (not shown) around a back-up roll 11 rotatably supported (by structure not shown) in an axially fixed position. At a locality at which the strip is held firmly against the back-up roll, a double-layer 12 of coating materials is applied to the outwardly facing major surface 10*a* of the strip from a multi-layer coating device 13. The coating device 13 extends over the entire width of the strip 10 at this locality. Beyond the roll 11, the strip is coiled again, e,g. on a driven re-wind reel (not shown) which, in such a case, may constitute the drive apparatus for advancement of the strip through the coating line.

The coating device 13 includes a moveable coating head 14 comprising a metal block 15 having a surface 16 facing but spaced from the roll 11 to define therewith a gap 17 through which the advancing strip 10 passes.

Formed in the head 14 is an elongated open-sided slot 18 which opens outwardly through the surface 16 of the coating head. The slot, in this embodiment, is an axially rectilinear passage having a uniform cross-section throughout. It is orientated with its long dimension transverse to the direction of advance A of the strip 10; most preferably, the long dimension of the slot is perpendicular to the direction of strip advance and parallel to the axis of rotation of the roll 11. By way of example, the width of slot 18 in the direction of strip advance (i.e. the width of the slot opening through surface 16) may be 1 mm (0.04 inch).

Figure 2:
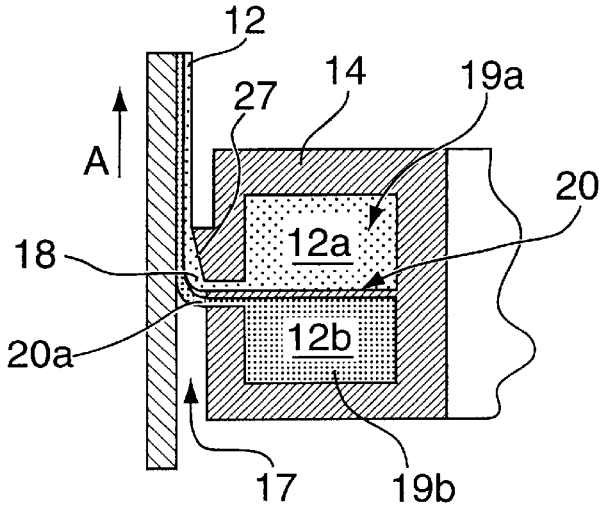
FIG. 2 is an enlarged sectional diagram of a coating head used in the apparatus of FIG. I for producing a two-layer film.

As best shown in FIG. 2, the slot 18 communicates at its interior side with a pair of enlarged coating material cavities 19*a*, 19*b* provided within the head and separated from each other by a thin wall or "septum" 20. One edge 20*a* of the septum extends into the inner part of the slot 18 for a short distance, but terminates short of the outer side of the slot 18. The septum 20, at least where it extends into the slot 18, is thin enough not to block the slot and, to the contrary, allows coating material to flow through the slot from both of the cavities 19*a*, 19*b*, which are normally respectively fed with different coating materials 12*a*, 12*b* under pressure. The coating materials from the two cavities merge at the edge 20*a* of the septum as they are extruded through the slot and form a combined flow that eventually forms the double coating layer 12.

Referring again to FIG. 1, the coating head 14 rests on a flat supporting plate 21 and is free to move over the plate towards or away from the roll 11 in the direction of double headed arrow B. The coating head is nevertheless fixed on the plate by a fixing pin 22, having an enlarged outer head 23. The pin 22 passes through a narrow but elongated hole 24 in the head and has its lower end screwed into a threaded hole in the plate 21. The enlarged head 23 of the pin engages the coating head at the edges of the hole 24, but allows the indicated movement in the direction of the double headed arrow B by virtue of the elongated nature of the hole 24 The hole 24 is, of course, positioned rearwardly of the cavities 19*a*, 19*b* so as not to interfere with the flow of coating material through the coating head.

The coating head 14 is connected at its end opposite to the roll 11 to a piston and cylinder device 25 supported on a supporting plate 26. The piston and cylinder device, when operated, acts as a force application device and exerts a force on the coating head 14 urging it in the direction of the roll 11. However, the coating head does not come into direct contact with the strip 10, but instead "floats" on the mass of combined coating materials emerging from the slot 18. This "floating" effect is caused by a balancing of the force from the piston and cylinder device 25 and the force exerted by the combined coating materials as they pass through the gap 17. The gap 17 narrows in the direction of arrow A because the coating head 14 has a coating surface (or "land") 27 (see FIG. 2 ), positioned immediately downstream of the slot 18, and that is angled inwardly relative to the surface of the strip 10. The combined coating material is consequently metered or spread by the coating surface 27 to form multiple coating layer 12 of the desired thickness as it loses contact with the coating head. The balancing of forces on the coating head 14 allows the head to move towards or away from the strip 10, preferably perpendicularly, while still "floating" on the coating material, to accommodate variations in thickness or surface height of the strip 10 while ensuring a uniform coating thickness. A combined layer 12 of constant thickness is thereby formed regardless of the thickness or surface height of the strip 10 at any particular location. This is achieved without the head contacting the strip directly, thereby avoiding scratching or scoring of the strip.

For a dual layer 12 to be formed by the apparatus described above, the flow of material through the slot 18 must be laminar, i.e. the feeds of material from cavities 19*a*, 19*b* must not mix significantly as they emerge from the slot. This is most likely to be achieved when the coating materials each have a relatively high viscosity, so this type of coating apparatus is particularly suitable for the coating of multiple layers ( 12*a*, 12*b*, . . . etc.) of molten polymers (which normally have a viscosity in the range of 1,000 to 2,000,000 CPS at 1 rad./sec according to ASTM D4440). The molten polymers may be supplied to the cavities 19*a*, 19*b* from screw extruder devices 28*a*, 28*b* (shown in cross-section in FIG. 1) via heated high pressure hoses 29*a*, 29*b* that communicate with the cavities 19*a*, 19*b* via entry ports 30*a*, 30*b*. The screw extruder devices thus act as coating material supply apparatus. The hoses may be conventional flexible hoses first wrapped with a conventional flexible heating element and then wrapped with a conventional thermal insulation. The screw extruders, themselves heated by integral heaters 31*a*, 31*b*, heat, mix, compress and pressurize pelletized plastic coating materials 32*a*, 32*b* withdrawn from hoppers 33*a*, 33*b*. The mixing action takes place as the pressure inside the extruder builds towards the front of the extruder and a backward counter-flow of material takes place (as indicated by the small arrows) in the gap between the screw mechanism 34*a*, 34*b* and the extruder wall 35*a*, 35*b*. It is also usually necessary to heat the coating head 14 itself (by means not shown) to keep the polymers molten and suitably fluid.

The strip article 10 may also be pre-heated (by means not shown) in advance of the roll 11 as a further way to prevent premature solidification of the polymers. Alternatively, or additionally, the roll 11 itself may be heated, e.g. by passing a heated fluid through a spiral channel beneath the roll surface.

The supporting plate 21 is mounted on a fixed frame 37 for pivotal movement about a horizontal axis 38, so as to enable the coating head 14, with the supporting plate, to be swung upwardly (e.g. by suitable pneumatic means, not shown) from the position illustrated in FIG. 1 to a position removed from the path of strip advance. An arm 39, fixedly secured to the frame 37 and underlying the supporting plate 21, carries a screw 40 that projects upwardly from the arm and bears against the lower surface of the supporting plate 21, to enable adjustment of the angular orientation of the coating head 14 in its operative position.

The frame 37 is fixed in position relative to the axis of the roll 11, both the frame and the roll being (for example) fixedly mounted in a common support structure (not shown). Thus, the axis 38 is fixed in position relative to the axis of the roll 11; and when the supporting plate 26 is in the operative position shown in FIG. 1, with the screw 40 set to provide a desired angular orientation, the roll 11 supports the advancing strip 10, opposite the slot 18, at a fixed distance from the supporting plate 26.

It will be appreciated that the coating materials 12*a*, 12*b* are applied to the strip 10 simultaneously and are both in the molten condition when the coating takes place. The coating cools and solidifies a short distance from the coating head 14 as cooling proceeds.

Figure 3:
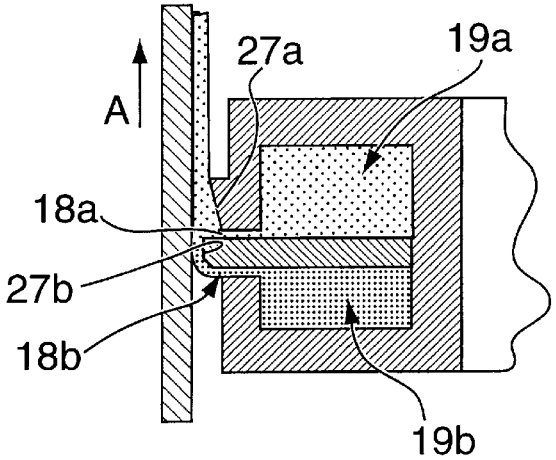
FIGS. 3, 4 and 5 are diagrams similar to FIG. 2 of alternative coating heads suitable for use in the present invention.
Figure 4:
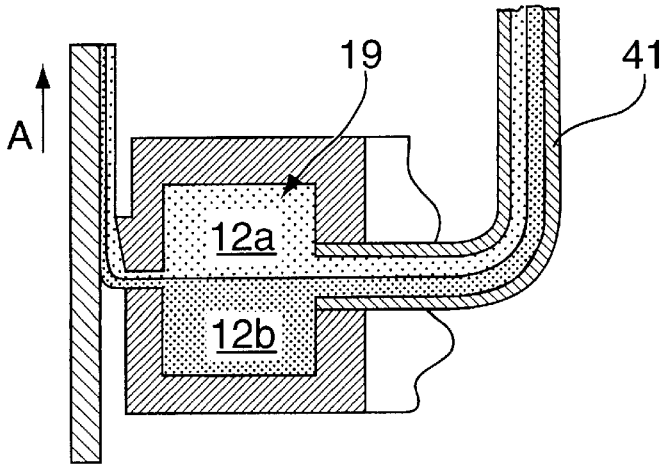
Figure 5:
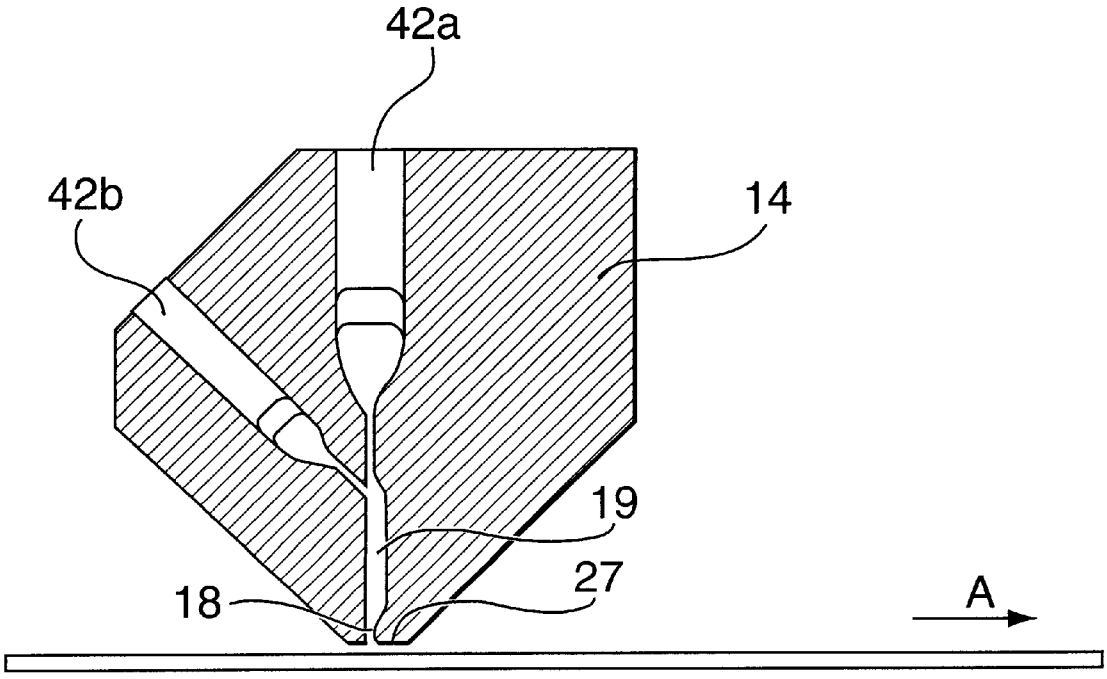

The coating head arrangement shown in FIGS. 1 and 2 may be replaced by other coating head designs, e.g. as shown in FIGS. 3, 4 and 5.

In the embodiment of FIG. 3, the coating head may be provided with a pair of coating slots 18*a*, 18*b* adjacent to one another in the coating head, one slot being positioned upstream with respect to the other slot in the direction of travel A of the strip 10. Each coating slot is provided with its own angled coating surface 27*a*, 27*b*. In this embodiment, the coatings flow separately from the coating head and are applied separately, one on top of the other, before both layers have solidified. As shown, the downstream coating surface 27*a* is positioned further away from the surface of the strip article than the upstream coating surface 27*b*. This is to accommodate the thickness of the first layer applied from the first slot 18*b* when the second layer is applied from the second slot 18*a*.

In the embodiment of FIG. 4, the septum 20 of FIG. 2 has been removed and instead the coating materials 12*a*, 12*b* are fed into the coating head in the form of adjacent laminar flows introduced from an inlet pipe 41. The separate flows can be produced, for example, by combining the hoses 29*a*, 29*b* from extrusion devices screw mechanisms 34*a*, 34*b* as shown in FIG. 1 in advance of the coating head in such a way that the illustrated side-by-side combined flow is obtained.

FIG. 5 shows a coating head 14 in which different coating materials are introduced via different inlets 42*a*, 42*b* and the materials (not shown in this Figure) are combined in a side-by-side fashion in a narrow elongated cavity 19 before being extruded from slot 18. The coating surface 27 of the illustrated coating device is quite narrow because the coating head is intended for forming thin coating layers (less than 10 microns) from high viscosity polymers. Such polymers require narrow surface to increase the per unit force to such an extent that the desired coating thickness is achieved.

In general terms, various parameters can be adjusted to form layers of desired thicknesses. For example, layer thicknesses may be governed by the width and angle of the coating surfaces 27, the force with which the coating head is urged towards the strip article, and the feed rate of the coating material to the coating head(s).

All of the embodiments of FIGS. 1 through 5 are particularly suitable for coating molten polymers of high viscosity.

For coating materials of lower viscosity, e.g. polymers dissolved in solvents (such as conventional paints), it is normally better to apply the multiple coatings sequentially from separate coating heads. This is because lower viscosity coating materials, such as paints, may tend to mix together if applied simultaneously in the manner of FIGS. 1 to 5. An example of a sequential coating arrangement is illustrated in FIGS. 6 and 7.

Figure 6:
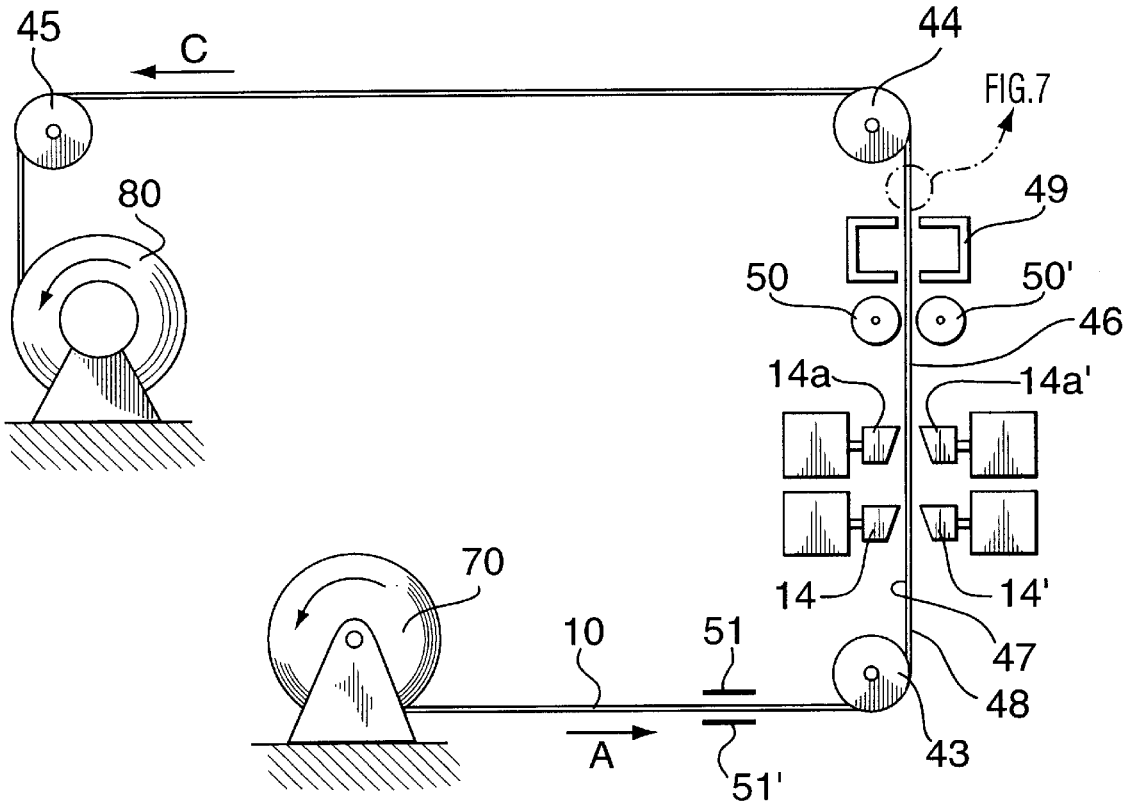
FIG. 6 is a schematic diagram of another embodiment according to the invention in which coating layers are applied separately to an elongated strip article.
Figure 7:
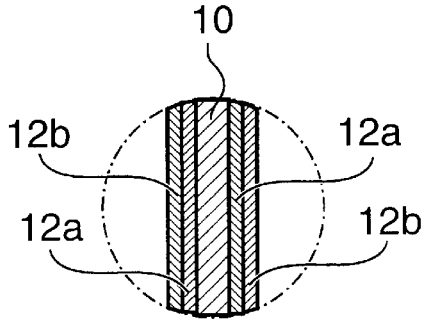
FIG. 7 is an enlarged, cross-sectional view of part of the coated article produced in the apparatus of FIG. 6

In the embodiment of FIG. 6, metal strip to be coated 10 is continuously advanced, in a direction longitudinally parallel to its long dimension, from a coil 70 along a path represented by arrows A and C extending successively around spaced guide rollers 43, 44 and 45 rotatably supported (by structure not shown) in axially fixed positions. The coil is then wound onto a roller 80, which may be driven by a motor (not shown) and thus acts as the means to advance the strip article 10 through the apparatus. The rollers 43 and 44 cooperatively define a rectilinear portion 46 of the path, in which portion the major surfaces of the advancing strip are substantially planar. At a locality in this path portion 46, coating material is applied to both major surfaces 47,48 of the strip 10 from two pairs of coating heads 14, 14' and 14*a*, 14*a*'. The heads of each pair are disposed in register with each other on opposite sides of the strip. Thus, the heads of each pair provide mutual support in the sense that the strip is held firmly between the respective coating heads being pushed towards the strip from opposite directions.

The first pair of coating heads 14, 14' apply a first (inner) coating layer 12*a* (see FIG. 7), and the pair of coating heads 14*a*, 14*a*' apply a second (outer) coating layer 12*b*, on each side of the strip. The pairs of coating heads on the same side of the strip are so positioned with respect to each other that, given the speed of advancement of the strip and the drying time of the first coating material, the second coating material is applied on top of the layer 12*a* of the first coating material before the first coating material is dry. Thus the coating can be characterized as "liquid-on-liquid" coating. The elapsed time between successive coatings is preferably less than about 0.5 seconds, and more preferably less than about 0.1 seconds. For example, for line speeds of 200 m/min, and a required re-coating time of about 0.2 seconds, the spacing between the two groups of coating heads would be about 0.6 m. This type of coating is found to be possible since the application of the second layer does not disrupt the first layer, and it is beneficial because the layers form a strong mutual bond when they dry together. It will be noted that no intermediate curing or drying step is required according to the present invention.

The coating heads 14, 14', 14*a*, 14*a*' may be of the type described in connection with the Innes patent, above and are supplied with liquid coating material in the same way. Usually, only one coating head of each pair is movable, the other being fixed. The strip article is capable of "floating" on the layer of coating material applied by the fixed coating head and the movable coating head then floats on the strip article.

It desired, heaters 51, 51' may be provided upstream of the coating heads to cause preliminary heating of the strip article 10 to avoid premature setting of polymeric coating materials (it used).

Of course, the embodiment of FIG. 6, may be modified to provide a single coating on one side of the strip article and a dual coating on the other. This may be achieved, for example, by replacing coating head 14 or 14' of the first pair of coating heads by a backing roller. Further alternatives would include providing two or more single coating heads at different positions around a large roll (of the type 11 shown in FIG. 1) to provide multiple layers on one side only of the strip article, or the provision of two single coating heads at the same relative positions on two adjacent rolls, again to provide a multiple coating on one side only of the strip article.

After the coatings have been applied, the strip may be advanced through a heating oven 49 to assure complete drying and, if necessary, curing of the coating layers. Alternatively, if the coating materials are molten polymers, the strip may be passed between cooled quench rolls 50, 50' to complete the solidification of the coatings.

In all embodiments of the present invention, it is preferable to choose coating materials that are compatible for liquid/liquid coating. In particular, the coating material used for the upper coating layer(s) should be capable of completely wetting the surface of the layer beneath while the layer beneath is still wet. Compatible combinations of hydrophilic/lipophilic properties are therefore desired.

The invention is described in more detail with reference to the following Examples. These Examples are provided for the sake of clarification and should not be taken as limiting the scope of the present invention.

EXAMPLE 1

Experiments were carried out using different coating materials and apparatus similar to that shown in FIG. 6 modified first of all to provide a coating layer on an upper surface of an aluminum strip and then a further coating layer on both the upper and lower surfaces of the strip, the second coating on the upper surface being applied over the first coating while the first coating is still wet. This produced a double coating layer on the upper surface of the strip and a single coating layer on the lower surface of the strip.

The coating apparatus used was a 10 cm (4 inch) wide single direct coater for the first application using two air cylinders to control the film thickness and a 10 cm (4 inch) wide double direct coater for the second application using two air cylinders mounted on the top coater head. The single and double coaters were positioned about 1.5 metres (5 feet) apart so that, at a line speed of 91 metres/min. (300 ft./min.), the residence time between coatings was about one second.

Experiment Run 596

A coating of CR22–174 can lacquer (a gold epoxy phenolic can lacquer sold by Dexter Midland) was applied in the single coater at a viscosity of 2,150 cps, and then layers of L8002 white polyester (Alcan formulation of high gloss white polyester top coat used for architectural products) were applied over the lacquer layer (while still wet) on the upper surface of the strip and directly over the metal on the lower surface of the strip at a viscosity of 1800 cps. The coated strip was subsequently fed through curing ovens set at 210° and 260° C. The air cylinder pressure of the single coater was 25 psi. and the cylinder pressure of the double coater was 103 kPa (15 psi).

The resulting single and double coatings had excellent surface properties. The lacquer film thickness was 2 microns and the polyester film thickness was 17 microns.

Experiment Run 598

A coating of VYES solution vinyl (a solution vinyl coating) was applied to the upper surface of the strip at a viscosity of 5,300 cps, and then a layer of L8002 white polyester (as above) was applied over the vinyl layer (while still wet) on the upper surface of the strip and directly over the metal on the lower surface of the strip at a viscosity of 1800 cps. The line speed was 91 metres/min (300 ft./min), and the coated strip was subsequently fed through curing ovens set at 260° and 260° C. The air cylinder pressure of the single coater was 40 psi. and the cylinder pressure of the double coater was 103 kPa (15 psi).

The resulting single and double coatings had excellent surface properties. The vinyl film thickness was 3 microns and the polyester film thickness was 17 microns.

EXAMPLE 2

The multi-layer coating process of the invention may be used to produce a material suitable for preparing a pre-coated metal strip for use as a starting material for the production of beverage cans (e.g. by means of deep drawing, and possibly drawing and ironing).

In this case, the strip article may be a coil of aluminum sheet of an appropriate alloy and gauge (for example AA3104, 0.0254 cm (0.01 inch)). Prior to coating, the sheet is pretreated using a commercially available pretreatment process known in the industry. Using a coating process of the type described in this invention, two or more coating layers are applied sequentially. For simplicity, the case of a two-layer coating is described below, although it will be recognized that one or more additional intermediate layers may be included.

The first layer is chosen to have good adhesion properties to the pretreated metal surface as well as the ability to bond well to the second layer. It also needs to have good formability so as to maintain integrity during forming of the beverage can product.

The second layer is also chosen to have good forming capabilities so as to maintain integrity during the forming operations. Furthermore, since the surface of this film will be adjacent to the forming tooling, a polymer having good lubricity is advantageous.

The thickness of the combined films, as applied, must take into account the stretching and concomitant reduction in thickness which occurs during the can-forming process. To achieve a final overall coating thickness of 8 microns, for example, the coating thickness which must be applied can be determined from the change in geometry and sidewall thickness which occurs during can forming.

For this application, the following coatings are provided as examples:

Coating Proposal no. 1: Polypropylene Film

| | |
|---|---|
| First layer: | maleic acid modified polypropylene (e.g. the product sold under the name Admer ®) |
| Second layer: | standard packaging grade of polypropylene. |

In this example, the maleic acid modified polypropylene offers excellent adhesion characteristics, but is relatively expensive. For this application, a relatively thin coating (e.g. approximately 5 microns) is sufficient.

A suitable grade of a lower cost polypropylene is chosen as the second layer to have good forming characteristics.

Coating Proposal no. 2: Polyester Film

| | |
|---|---|
| First layer: | modified polyester - polyesters with good adhesion to pretreated aluminum are commercially available (e.g. Dupont ® 8306) and for demanding applications, adhesion promoting additives are available. Since this would be comparatively costly, a relatively thin layer (e.g. approximately 5 microns) is provided. |
| Second Layer: | lower cost packaging grade of polyester. The lowest cost polyesters have relatively high melting points and do not have optimum rheological properties for this coating process. However, there is a wide variety of medium priced polyesters which have suitable property combinations. To improve lubricity, internal lubricant additives, such as a suitable grade of polyethylene, may be incorporated to aid in the forming process. |

It is, of course, to be understood that the invention is not limited to the features and embodiments herein-above specifically set forth but may be carried out in other ways without departure from its spirit or scope.

What is claimed is:

1. A method of applying a multi-layer coating to a surface of an elongated strip article of variable thickness or surface height, which involves applying at least two layers of different coating materials in the form of solidifiable fluids onto said surface of said elongated strip article and reducing said layers to a desired thickness by causing said applied coating materials to encounter at least one coating surface that is movable substantially perpendicularly relative to said strip article and is urged towards said strip article in opposition to hydrodynamic force generated by said coating materials on said at least one coating surface, thereby accommodating variations in thickness of said strip article or differences of surface height without varying said coating thickness substantially, wherein said layers are applied one on top of another such that an outer layer is applied on top of an immediately underlying layer before said immediately underlying layer has solidified.

2. A method according to claim 1, wherein said solidifiable fluid of each layer is a molten polymer.

3. A method according to claim 2, wherein said strip article is heated to an elevated temperature before said coating materials are applied.

4. A method according to claim 2, wherein said molten polymer is a molten thermoplastic polymer selected from the group consisting of a polyester, a polyolefin, a polycarbonate, and a vinyl polymer.

5. A method according to claim 2, wherein said molten polymer is a thermosetting polymer.

6. A method according to claim 5, wherein the thermosetting polymer is an epoxy resin.

7. A method according to claim 1, wherein the solidifiable fluid of each layer is a solid dissolved in a volatile organic solvent.

8. A method according to claim 1, wherein the solidifiable fluid is a solid dissolved in a water-based solvent.

9. A method according to claim 1, wherein said layers are applied to said surface simultaneously.

10. A method according to claim 1, wherein said layers are applied to said surface sequentially.

11. A method according to claim 1, wherein said layers are applied by a coating apparatus having Fit least one open-sided elongated slot through which said layers are extruded, and the coating surface positioned adjacent to said slot on a side of said slot that is downstream with respect to a direction of travel of said strip article relative to said slot.

12. A method according to claim 11, wherein said coating apparatus has a single elongated slot, and said different coating materials are extruded simultaneously and in a laminar fashion from said slot.

13. A method according to claim 11, wherein said coating apparatus has a single coating head provided with more than one elongated slot, each slot having an associated coating surface, and each one of said coating materials is extruded from a different slot.

14. A method according to claim 11, wherein said coating apparatus has more than one coating head each provided with an elongated slot and an associated coating surface, said coating heads being arranged sequentially in a direction of travel of said strip article relative to said coating apparatus, and each of said different coating materials is extruded from a different one of said coating heads.

15. Apparatus for applying a multi-layer coating to a surface of an elongated strip article of variable thickness or surface height, comprising:

at least one coating head provided with at least one open-sided slot and at least one associated coating surface adjacent to said slot for contacting and metering coating material emerging from said slot, each said coating surface being movable substantially perpendicularly relative to said strip article;

force application device for urging each said coating surface towards said elongated strip to counterbalance a hydrodynamic force exerted on each said coating surface by coating material contacting said coating surface;

drive apparatus for advancing said elongated strip past said at least one coating head; and supply apparatus for supplying at least two solidifiable liquid coating materials to said at least one coating head to be applied to said surface of said strip article in the form of coating layers arranged one on top of another;

wherein said open-sided slots are positioned relative to each other and said drive apparatus operates such that, in use, an upper coating layer is applied on top of an immediately lower coating layer before said lower layer has solidified.

16. Apparatus according to claim 15, including means to heat the elongated strip article to an elevated temperature before said elongated strip article is advanced past said at least one coating head.

17. Apparatus according to claim 15, having a single coating head provided with a single open-aided slot and a single coating surface, wherein said supply apparatus supplies two coating materials to said slot in laminar flow to emerge as overlying layers on said elongated strip article and to contact said coating surface.

18. Apparatus according to claim 17, wherein said supply apparatus includes two cavities in said coating head separated by a wall extending partially into said slot at one end, but allowing coating material to emerge into said slot from each of said cavities at said one end of said wall.

19. Apparatus according to claim 17, wherein said supply apparatus includes a supply pipe leading to a single cavity in said supply head communicating with said slot, said supply pipe being fed with two coating materials forming separate and adjacent layers in said supply pipe.

20. Apparatus according to claim 17, wherein said supply apparatus includes two supply pipes formed in said coating head, each communicating with a cavity in said head communicating in turn with said slot to create separate layers of coating material in said cavity that ultimately emerge from said slot.

21. Apparatus according to claim 15, having a single coating head provided with two open-sided slots and two coating surfaces adjacent said slots, wherein said supply apparatus supplies a different coating material to each slot.

22. Apparatus according to claim 15, comprising two or more coating heads, each provided with a single slot and an adjacent coating surface, said coating heads being arranged sequentially along a path of advancement of said strip article, and said supply apparatus supplying a coating material to each said coating head.

* * * * *